US009481614B2

(12) United States Patent
Daniels et al.

(10) Patent No.: US 9,481,614 B2
(45) Date of Patent: Nov. 1, 2016

(54) ENERGETIC MATERIALS AND METHODS OF TAILORING ELECTROSTATIC DISCHARGE SENSITIVITY OF ENERGETIC MATERIALS

(71) Applicant: Battelle Energy Alliance, LLC, Idaho Falls, ID (US)

(72) Inventors: Michael A. Daniels, Idaho Falls, ID (US); Ronald J. Heaps, Idaho Falls, ID (US); Ronald S. Wallace, Ucon, ID (US); Michelle L. Pantoya, Lubbock, TX (US); Eric S. Collins, Abingdon, MD (US)

(73) Assignees: Battelle Energy Alliance, LLC, Idaho Falls, ID (US); Texas Tech University System, Lubbock, TX (US)

( * ) Notice: Subject to any disclaimer, the term of this patent is extended or adjusted under 35 U.S.C. 154(b) by 107 days.

(21) Appl. No.: 14/050,642

(22) Filed: Oct. 10, 2013

(65) Prior Publication Data

US 2015/0101719 A1 Apr. 16, 2015

(51) Int. Cl.

| | |
|---|---|
| ***C06B 33/00*** | (2006.01) |
| ***D03D 23/00*** | (2006.01) |
| ***D03D 43/00*** | (2006.01) |
| ***C06B 45/04*** | (2006.01) |
| ***C06B 45/10*** | (2006.01) |
| ***C06B 23/00*** | (2006.01) |
| ***C06B 27/00*** | (2006.01) |

(52) U.S. Cl.

CPC ..... *C06B 45/04* (2013.01); *C06B 23/009* (2013.01); *C06B 27/00* (2013.01); *C06B 33/00* (2013.01); *C06B 45/10* (2013.01)

(58) Field of Classification Search

USPC ..... 149/19.3, 37, 108.2, 108.8, 109.2, 149/109.4, 109.6

See application file for complete search history.

(56) References Cited

U.S. PATENT DOCUMENTS

| | | | |
|---|---|---|---|
| 5,717,159 | A | 2/1998 | Dixon et al. |
| 7,578,895 | B1 | 8/2009 | Chen et al. |
| 7,632,364 | B1 | 12/2009 | Jouet et al. |
| 7,754,036 | B1 | 7/2010 | Newman et al. |
| 7,951,248 | B1 | 5/2011 | Fallis et al. |
| 8,007,608 | B1 | 8/2011 | Herbage et al. |
| 8,048,241 | B1 | 11/2011 | Davison |
| 8,172,965 | B2 | 5/2012 | Daoud et al. |
| 8,257,523 | B1 | 9/2012 | Puszynski et al. |
| 8,454,770 | B1 | 6/2013 | Erickson et al. |

(Continued)

FOREIGN PATENT DOCUMENTS

| | | | |
|---|---|---|---|
| WO | WO 8500364 A | * | 1/1985 |
| WO | 2008/082724 | | 7/2008 |

OTHER PUBLICATIONS

Balberg et al., "Excluded volume and its relation to the onset of percolation," Physical Review B, vol. 30, No. 7, pp. 3933-3943, 1984.

(Continued)

*Primary Examiner* — James McDonough
(74) *Attorney, Agent, or Firm* — TraskBritt

(57) ABSTRACT

An energetic material comprising an elemental fuel, an oxidizer or other element, and a carbon nanofiller or carbon fiber rods, where the carbon nanofiller or carbon fiber rods are substantially homogeneously dispersed in the energetic material. Methods of tailoring the electrostatic discharge sensitivity of an energetic material are also disclosed.

22 Claims, 5 Drawing Sheets

(56) References Cited

U.S. PATENT DOCUMENTS

| | | | | |
|---|---|---|---|---|
| 2006/0011083 | A1* | 1/2006 | Perry | B82Y 30/00 102/205 |
| 2006/0060272 | A1* | 3/2006 | Naud | C06B 33/00 149/37 |
| 2006/0113014 | A1 | 6/2006 | Puszynski et al. | |
| 2006/0266204 | A1* | 11/2006 | Givens | C06B 33/00 89/1.14 |
| 2010/0009165 | A1 | 1/2010 | Patel et al. | |
| 2010/0193093 | A1* | 8/2010 | Coffey | B22F 1/0003 149/15 |
| 2011/0240184 | A1 | 10/2011 | Higa et al. | |
| 2011/0240185 | A1 | 10/2011 | Higa et al. | |
| 2011/0240186 | A1 | 10/2011 | Higa et al. | |
| 2012/0060984 | A1 | 3/2012 | Gogotsi et al. | |
| 2014/0260185 | A1 | 9/2014 | Seidner et al. | |

OTHER PUBLICATIONS

Bao et al., "Effects of the dispersion state and aspect ratio of carbon nanotubes on their electrical percolation threshold in a polymer," Journal of Applied Polymer Science, vol. 128, No. 1, pp. 735-740, Apr. 2013.

Densmore et al., "Thermal imaging of nickel-aluminum and aluminum-polytetrafluoroethylene impact initiated combustion," Journal of Applied Physics, vol. 112, No. 8, p. 084911, 2012.

Koch, E.-C., "Metal-Fluorocarbon-Pyrolants: III. Development and Application of Magnesium/TeflonNiton (MTV)," Propellants, Explosives, Pyrotechnics, vol. 27, No. 5, pp. 262-266, Nov. 2002.

Kuwahara, et al., "Combustion and sensitivity characteristics of Mg/TF pyrolants," Propellants, Explosives, Pyrotechnics, vol. 202, pp. 198-202, 2004.

Mutiso et al., "Simulations and generalized model of the effect of filler size dispersity on electrical percolation in rod networks," Physical Review B, vol. 86, No. 21, p. 214306, Dec. 2012.

Sandler et al., "Development of a dispersion process for carbon nanotubes in an epoxy matrix and the resulting electrical properties," Polymer, vol. 40, pp. 5967-5971, 1999.

Sandler et al., "Ultra-low electrical percolation threshold in carbon-nanotube-epoxy composites," Polymer, vol. 44, No. 19, pp. 5893-5899, Sep. 2003.

Siegert et al., "Reduced-Sensitivity Nanothermites Containing Manganese Oxide Filled Carbon Nanofibers," J. Phys. Chem. C 2010, 114, 19562-19568.

Weir et al., "Electrostatic Discharge Sensitivity of Composite Energetic Materials," Journal of Electrostatics, vol. 71, pp. 77-83 (2013).

Weir et al., "The role of aluminum particle size in electrostatic ignition sensitivity of composite energetic materials," Combustion and Flame, May 2013.

* cited by examiner

ENERGETIC MATERIALS AND METHODS OF TAILORING ELECTROSTATIC DISCHARGE SENSITIVITY OF ENERGETIC MATERIALS

STATEMENT REGARDING FEDERALLY SPONSORED RESEARCH OR DEVELOPMENT

This invention was made with government support under Contract Number DE-AC07-051D14517 awarded by the United States Department of Energy. This invention was also made with government support under Contract Number W911NF-11-1-0439 awarded by the Army Research Office. The government has certain rights in the invention.

TECHNICAL FIELD

The disclosure, in various embodiments, relates generally to energetic materials and to methods of reducing electrostatic discharge (ESD) sensitivity in energetic materials. More specifically, the disclosure, in various embodiments, relates to energetic materials that include a carbon nanofiller to tailor the ESD sensitivity of the energetic materials and to methods of forming such energetic materials.

BACKGROUND

Energetic materials, especially those used as first-fire mixes, are susceptible to unintentional ESD initiation, which is not desired due to risk to person, property, or mission. However, ESD is difficult to eliminate in real-world situations because the amount of energy required to initiate an energetic material by ESD is usually several of orders of magnitude less than the amount of energy used to initiate the energetic material by other modes of initiation, such as heat, impact, or friction. It is also difficult to reduce the ESD sensitivity while maintaining desired modes of initiation and the desired performance of the energetic material. Accidental ESD initiation is problematic with thermite compositions, such as aluminum/copper oxide compositions, and intermetallic compositions, such as aluminum/nickel compositions. Thermite and intermetallic compositions are susceptible to accidental initiation by ESD since the fuels and oxidizers are usually in powder form. The addition of a fluoropolymer, such as VITON®, or alumina to the energetic material has also been tested. However, the exothermic reaction was affected and the ESD sensitivity was not greatly improved.

A composite energetic material (CEM) is a class of energetic materials that includes fuel and oxidizer particles that are highly exothermic upon ignition. CEMs are also referred to in the art as thermites, reactive materials, and pyrotechnics. If the particle size of the components is on the nanoscale, then the CEMs may also be referred to as nanothermites, superthermites, metastable intermolecular composites, metastable interstitial composites, or metastable nanoenergetic composites. CEMs may be tailored toward specific applications by adjusting the compounds used as the fuel and oxidizer, unlike conventional explosive compositions whose reactivity is kinetically limited by the monomolecular crystal structure.

To reduce the mechanical sensitivity of a manganese oxide/aluminum composition, carbon nanofibers have been filled with the manganese oxide. The manganese oxide and the aluminum are, thus, alleged to be separated from one another and the composition exhibited reduced mechanical sensitivity (friction sensitivity) compared to a manganese oxide/aluminum composition lacking the carbon nanofibers. The filled carbon nanofiber composition also had a decrease in ESD sensitivity compared to the manganese oxide/aluminum composition lacking the carbon nanofibers. The filled carbon nanofiber composition was also compared to a composition including manganese oxide and aluminum mixed with unfilled carbon nanofibers. The filled carbon nanofiber composition had an ESD sensitivity of 35 mJ while the unfilled carbon nanofiber composition had an ESD sensitivity of 1800 mJ.

It would be desirable to be able to further tailor the ESD sensitivity of energetic materials.

BRIEF SUMMARY

An embodiment of the disclosure includes an energetic material comprising an elemental fuel, an oxidizer or at least one other element, and a carbon nanofiller. The carbon nanofiller is substantially homogeneously dispersed in the energetic material.

Another embodiment of the disclosure includes a method of tailoring ESD sensitivity of an energetic material. The method comprises substantially homogeneously dispersing a carbon nanofiller with an elemental fuel and an oxidizer or at least one other element to form an energetic material.

Yet another embodiment of the disclosure includes an energetic material comprising an elemental fuel, an oxidizer, and carbon fiber rods. The carbon fiber rods are substantially homogeneously dispersed in the energetic material.

DETAILED DESCRIPTION

Figure 1:
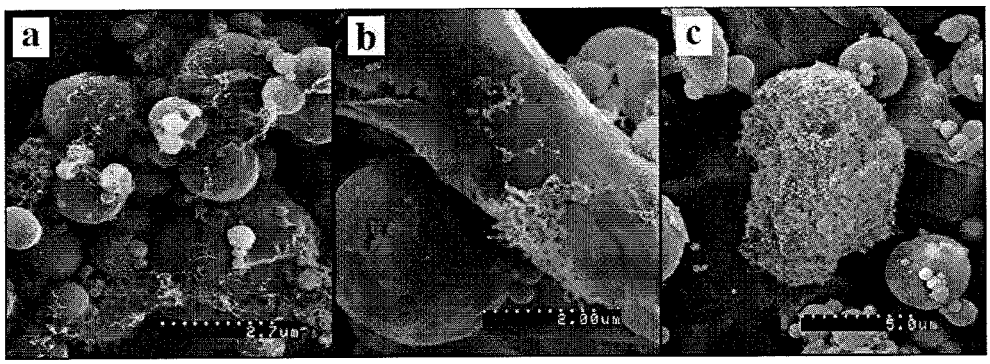
FIGS. 1*a*-1*c* are scanning electron microscopy (SEM) images of energetic materials according to embodiments of the disclosure.

Energetic materials are disclosed that include a thermite composition or an intermetallic composition, and a carbon nanofiller. The carbon nanofiller is substantially homogeneously dispersed in the energetic material and is present in an amount that provides sufficient electrical connections through the energetic material to dissipate electrostatic discharge (ESD). However, the amount of carbon nanofiller does not negatively affect the energetic performance of the energetic material, or other (e.g., non-ESD) modes of initiation. Thus, the energetic material may be initiated by a desired mode of initiation and yet may exhibit a reduced sensitivity to ESD initiation. Thus, the energetic materials are more resistant to initiation by ESD and have a reduced risk of accidental initiation by ESD. The energetic material may be a thermite composition, an intermetallic composition, or a pyrotechnic composition. If the energetic material is a thermite composition, the thermite composition includes an elemental fuel, an oxidizer, and the carbon nanofiller. If the energetic material is an intermetallic composition, the intermetallic composition includes aluminum as the elemental fuel, at least one other element, and the carbon nanofiller. The carbon nanofiller may be used in any energetic material that is sensitive to ESD initiation. Thus, energetic materials may be tailored to be less sensitive to ESD initiation while maintaining their energetic performance and initiation by other modes of initiation, such as mechanical, thermal, impact, friction, or percussion.

As used herein, the term "carbon nanofiller" means and includes a carbon material having at least one dimension (e.g., a diameter or thickness) less than or equal to about 100 nanometers. The carbon nanofiller may exhibit a cylindrical (e.g., tubular) morphology, such as carbon nanotubes (CNTs), or a platelet morphology, such as graphene nanoplatelets (GNPs). If the carbon nanofiller includes carbon nanotubes (CNTs), the diameter of the carbon nanotubes may be less than about 100 nm. If the carbon nanofiller includes graphene nanoplatelets (GNPs), the thickness of the graphene nanoplatelets may be less than about 100 nm and the diameter may be less than about 100 μm.

As used herein, the term "thermite composition" means and includes a composition having the elemental fuel, an oxide or a fluoropolymer as the oxidizer, and the carbon nanofiller. When initiated, the elemental fuel chemically reduces the oxidizer, resulting in a highly exothermic reduction-oxidation reaction. For instance, if the oxidizer is a metal oxide, the elemental fuel is oxidized and the metal oxide is reduced to metal upon initiation of the energetic material.

As used herein, the term "elemental fuel" means and includes a metal, metalloid, alkali metal, alkaline earth, lanthanide, or actinide element. The elemental fuel may include, but is not limited to, aluminum, boron, beryllium, hafnium, lanthanum, lithium, magnesium, neodymium, tantalum, thorium, titanium, yttrium, zirconium, or combinations thereof.

As used herein, the term "intermetallic composition" means and includes a composition having aluminum as the elemental fuel, the at least one other element, and the carbon nanofiller. The at least one other element is a non-metal, metal, metalloid, alkali metal, alkaline earth, lanthanide, or actinide element including, but not limited to, boron, carbon, calcium, cerium, cobalt, chromium, copper, iron, lanthanum, lithium, manganese, nickel, palladium, praseodymium, platinum, plutonium, sulfur, tantalum, titanium, uranium, vanadium, zirconium, or combinations thereof. The at least one other element may react with the aluminum to form an alloy upon initiation of the energetic material. As the aluminum and at least one other element react, exothermic energy is produced. The intermetallic composition may include a metal, metalloid, alkali metal, alkaline earth, lanthanide, or actinide element other than aluminum as the elemental fuel.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

The elemental fuel may have an average particle size of between about 20 nm and about 100 μm, such as between about 20 μm and about 70 μm, or between about 20 μm and about 50 μm. By way of example, the elemental fuel may have an average particle size of between about 20 nm and about 20 μm. In one embodiment, the elemental fuel is aluminum. In another embodiment, the elemental fuel is aluminum having an average particle size distribution of between about 3 μm and about 4.5 μm. An additional, optional, component of the energetic material may also function as a fuel, in combination with the elemental fuel. The optional fuel component may be an organic compound including, but not limited to, trinitrotoluene (TNT), hexogen (RDX), octogen (HMX), hexaazaisowurtzitane (CL-20), or hydroxyl-terminated polybutadiene (HTPB). However, when the organic compound is present in the energetic material, the organic component is present in combination with one of the above-mentioned elemental fuels.

The oxidizer may be an oxide, a perchlorate, a permanganate, a nitrate, a chloride, a fluoropolymer, or combinations thereof. Examples of oxides include, but are not limited to, a silver oxide (AgO, $Ag_2O$), a boron oxide ($B_2O_3$), a bismuth oxide ($Bi_2O_3$), a cobalt oxide (CoO, $Co_3O_4$), a chromium oxide ($Cr_2O_3$), a copper oxide (CuO, $Cu_2O$), an iron oxide ($Fe_2O_3$, $Fe_3O_4$), a mercury oxide (HgO), an iodide oxide ($I_2O_5$), a manganese oxide ($MnO_2$), a molybdenum oxide ($MoO_3$), a niobium oxide ($Nb_2O_3$), a nickel oxide (NiO, $Ni_2O_3$), a lead oxide (PbO, $PbO_2$, $Pb_3O_4$), a palladium oxide (PdO), a tin oxide (SnO, $SnO_2$), a tantalum oxide ($Ta_2O_5$), a titanium oxide ($TiO_2$), a uranium oxide ($U_3O_8$), a vanadium oxide ($V_2O_5$), a tungsten oxide ($WO_2$, $WO_3$), or combinations thereof. Examples of perchlorates include, but are not limited to, potassium perchlorate, sodium perchlorate, ammonium perchlorate, or combinations thereof. Examples of permanganates include, but are not limited to, potassium permanganate, ammonium permanganate, sodium permanganate, or combinations thereof. Examples of nitrates include, but are not limited to, potassium nitrate, barium nitrate, ammonium nitrate, or combinations thereof. One example of a chloride includes, but is not limited to, potassium chloride. The oxidizer may also be a silicon oxide (SiO, $SiO_2$), or a silicon oxide in combination with at least one of the previously-mentioned oxidizers. The oxide, perchlorate, or permanganate may have an average particle size of between about 20 nm and about 100 μm. If, however, the energetic material includes aluminum and CNTs, the oxidizer is not manganese oxide.

The fluoropolymer may include, but is not limited to, polytetrafluoroethylene (PTFE), a copolymer of hexafluoropropylene and vinylidene fluoride, a terpolymer of tetrafluoroethylene, hexafluoropropylene, and vinylidene fluoride, or combinations thereof. The fluoropolymer may have an average particle diameter of less than about 100 μm, such as less than about 50 μm.

In one embodiment, the oxidizer is PTFE. In another embodiment, the oxidizer is copper(II) oxide.

The carbon nanofiller may be electrically conductive and may remain substantially inert (e.g., substantially nonreactive with the elemental fuel and/or oxidizer) during the exothermic reaction produced upon initiation of the energetic material. The carbon nanofiller may account for only a small percentage of the total amount of the energetic material, such as less than or equal to about 25% by volume of the energetic material. Thus, the overall combustion performance of the energetic material is not significantly affected by the presence of the carbon nanofiller. The carbon nanofiller may be carbon nanotubes (CNTs), graphene nanoplatelets (GNPs), or combinations thereof. The carbon nanotubes may be single-walled carbon nanotubes, multi-walled carbon nanotubes, or combinations thereof having a diameter of less than about 50 nm. The graphene nanoplatelets may exhibit a platelet morphology having a high aspect ratio (a thickness of less than about 50 nm and a diameter of less than about 100 μm). The carbon nanofiller may be commercially available, such as from Alfa Aesar (Ward Hill, Mass.) or Graphene Supermarket (Calverton, N.Y.). While CNTs and GNPs are described herein, the morphology of the carbon nanofiller is not limited to tubes and platelets. Other morphologies may be used, such as spherical, ellipsoidal, or other known morphologies.

In one embodiment, the carbon nanofiller includes CNTs having an outer diameter of from about 3 nm to about 20 nm, an inner diameter of from about 1 nm to about 3 nm, and a length of from about 0.1 μm to about 10 μm. In another embodiment, the carbon nanofiller includes GNPs having a thickness of about 8 nm and a length of from about 0.15 μm to about 3.0 μm.

In one embodiment, the energetic material includes aluminum, PTFE, and CNTs. In another embodiment, the energetic material includes aluminum, cupric oxide, and CNTs.

The carbon nanofiller may be present in the energetic material at from about 0.5% by volume to about 25% by volume, such as from about 0.8% by volume to about 15% by volume, from about 1% by volume to about 10% by volume, or from about 1% by volume to about 5% by volume. The carbon nanofiller may be present in an amount that exceeds the percolation threshold of the energetic material and provides sufficient electrical connections in the energetic material to dissipate ESD rather than initiate the energetic material. However, the carbon nanofiller may be present at a minimal amount so that energetic performance of the energetic material is not decreased but yet the desired level of ESD protection is achieved. In addition, the presence of the carbon nanofiller may not significantly affect the desired mode of initiating the energetic material or the reaction rate of the energetic material. The amount of carbon nanofiller in the energetic material may be selected depending on the particle size, particle shape, and chemistry of the other components of the energetic material, such as the elemental fuel, oxidizer, other element, or optional components.

The elemental fuel and the oxidizer, or the elemental fuel and the at least one other element, may account for the balance of the energetic material, such as from about 20% by volume to about 99.5% by volume of the energetic material. The elemental fuel and the oxidizer may be present in the energetic material at a fuel/oxidizer equivalence ratio (F/O ER) of from about 0.8 to about 5, such as from about 0.8 to about 1.5 or from about 1.0 to about 1.5. The relative amounts of the elemental fuel and the oxidizer may be selected such that the energetic material is fuel rich (F/O ER greater than 1), stoichiometric (F/O ER equal to 1), or fuel lean (F/O ER less than 1).

The energetic material may be produced by combining the carbon nanofiller, the elemental fuel, the oxidizer or other element, and any optional components. The carbon nanofiller may be combined with the elemental fuel and oxidizer or other element by conventional mixing processes, such as by sonication, mechanical wet mixing, or dry mixing processes. For instance, the elemental fuel and oxidizer or other element may be combined, and then the carbon nanofiller added to the elemental fuel/oxidizer or elemental fuel/other element. Alternatively, the carbon nanofiller, elemental fuel, and oxidizer or other element may be combined in a single process act. Solvents or processing aids may, optionally, be used during the mixing. After mixing, the carbon nanofiller may be substantially homogeneously dispersed throughout the energetic material, the term "substantially homogeneously" indicating the potential for minute volumes of energetic material having a slightly more or less homogeneous composition due to limits of even the most effective mixing techniques. Once mixed, any solvents or processing aids may be removed by conventional techniques, producing the energetic material.

The resulting energetic material may include the elemental fuel in contact with the oxidizer or the other element, and the carbon nanofiller dispersed throughout the elemental fuel and oxidizer or the other element, as shown in FIGS. 1*a* and 1*b*. Any openings in the carbon nanofiller, such as openings in the CNTs, may be substantially free of the elemental fuel and of the oxidizer or the element. In other words, each of the elemental fuel and oxidizer or other element does not enter the openings in the CNTs to any appreciable extent. By way of example, the CNTs may include less than 1% by volume of the elemental fuel or the oxidizer or other element in its tubular structure. The resulting energetic materials retain their original energetic properties, other than being insensitive to ESD initiation.

Without being bound by any theory, it is believed that the carbon nanofiller in the energetic material may reduce the ESD sensitivity by exceeding the percolation threshold of the energetic material. By utilizing carbon fillers that are nanometer-sized, better percolation of the energetic material may be achieved. The carbon nanofiller may provide a conductive path (e.g., network) between the elemental fuel and the oxidizer or other element of the energetic material. Thus, the carbon nanofiller may provide sufficient electrical connections in the energetic material to dissipate the ESD, rather than the ESD initiating the energetic material. Even at high ESD levels, such as greater than or equal to 100 μS/cm, the ESD is dissipated through the energetic material rather than causing initiation of the energetic material. It is also believed that using the CNTs as the carbon nanofiller, or a combination of the CNTs and GNPs, creates percolation at a lower volumetric percentage than using GNPs alone.

Energetic materials are also disclosed that include carbon fillers having a larger size, such as carbon fiber rods. The carbon fiber rods may be conductive and may be used in the energetic materials instead of, or in combination with, the carbon nanofillers described above. The carbon fiber rods may be milled carbon fibers having a length of less than about 450 μm, such as between about 50 μm and about 450 μm, such as those commercially available from Toho Tenax America (Rockwood, Tenn.) under the TENAX® tradename. The carbon fiber rods may account for from about 0.5% by volume to about 10% by volume of the energetic material. By way of example, the carbon fiber rods may be used instead of the carbon nanofillers described above. For instance, the energetic material may include a fuel, oxidizer, and the carbon fiber rods. In one embodiment, the energetic material includes aluminum, potassium perchlorate, and the carbon fiber rods.

By including the carbon nanofiller in the energetic material, the sensitivity of the energetic material to ESD initiation may be tailored. By tailoring the reactivity of the energetic material to ESD, the performance properties of the energetic material may be tailored for specific applications. Thus, energetic materials having increased ESD sensitivity may be produced for use in applications where ESD sensitivity is problematic. However, an energetic material may be tailored to exhibit a decreased ESD sensitivity for use in applications where ESD sensitivity is not problematic. By way of example only, the carbon nanofiller may be added to energetic materials for use such as fireworks, thermites, or intermetallics.

The following examples serve to explain embodiments of the present disclosure in more detail. These examples are not to be construed as being exhaustive or exclusive as to the scope of this disclosure.

EXAMPLES

Example 1

Al/PTFE Energetic Materials Including CNTs, GNPs, or CNTs/GNPs

Energetic materials including aluminum and PTFE with different percentages of the carbon nanofiller were prepared. The energetic materials had an F/O ER of 1. Carbon nanotubes (CNTs) and graphene nanoplatelets (GNPs) were added to the energetic materials to determine the effect on electrical conductivity and ESD ignition sensitivity of the energetic material since there is a correlation between these properties. The carbon nanofiller included carbon nanotubes (CNTs), graphene nanoplatelets (GNPs), or combinations thereof. Multi-walled carbon nanotubes (CNTs) and graphene nanoparticles (GNPs) were used as the carbon nanofiller and were purchased from Alfa Aesar (Ward Hill, Mass.) and Graphene Supermarket (Calverton, N.Y.), respectively. As provided by the manufacturer, the CNTs had an outer diameter of 3 nm-20 nm, an inner diameter of 1 nm-3 nm, and a length of 0.1 μm-10 μm. As provided by the manufacturer, the GNPs were flakes having a thickness of 8 nm and a length of 0.15 μm-3.0 μm. Volumetric percentages of the CNTs ranged from 0.2% by volume to 2.0% by volume of the Al/PTFE energetic material. Volumetric percentages of the GNPs ranged from 0.5% by volume to 4.0% by volume of the Al/PTFE energetic material. The amount of CNTs and/or GNPs used for each corresponding volume percent of carbon nanofiller is shown in Table 1.

TABLE 1

| Volume Percent of Carbon Nanofiller | | | | | | |
|---|---|---|---|---|---|---|
| CNT | | GNP | | GNP/CNT | | |
| Vol. % Added | Mass (mg) | Vol. % Added | Mass (mg) | Ratio of GNP/CNT | Mass GNP (mg) | Mass CNT (mg) |
| 0.2% | 1.8 | 0.5% | 5.6 | 0/100 | 0 | 17.9 |
| 0.5% | 4.5 | 1.0% | 11.2 | 20/80 | 4.5 | 14.3 |
| 1.0% | 8.9 | 2.0% | 22.4 | 40/60 | 8.9 | 10.7 |
| 2.0% | 17.9 | 3.0% | 33.5 | 60/40 | 13.4 | 7.2 |
| | | 4.0% | 44.7 | 80/20 | 17.9 | 3.6 |
| | | | | 100/0 | 22.4 | 0 |

Aluminum (Al) powder with particle sizes of 3 μm-4.5 μm was used as the elemental fuel and polytetrafluoroethylene (PTFE) powder with an average particle diameter of 35 μm was used as the oxidizer. The aluminum and PTFE were purchased from Alfa Aesar (Ward Hill, Mass.). Although a control Al/PTFE energetic material lacking the carbon nanofiller was not ESD sensitive since the Al and PTFE used were μm sized, the carbon nanofiller was added to this baseline formulation to determine whether the energetic material became ESD sensitive as increasing percentages of the carbon nanofiller were present. By adding increasing percentages of the carbon nanofiller to the Al/PTFE energetic material, it was believed that the electrical conductivity of the energetic material would be effected, resulting in a corresponding effect in ESD sensitivity.

A stoichiometric equivalence ratio was prepared for each test based on the elemental fuel and oxidizer particles. Once proportioned, hexane was added to the Al and PTFE powders and sonicated. The Al/PTFE solution was then poured into a PYREX® dish to evaporate the hexane in a fume hood and leave behind the Al/PTFE. The carbon nanofiller was then added by different processes, as described below.

An aqueous dispersant for multi-walled CNTs, purchased from Alfa Aesar (no. 44276), was used to disperse the carbon nanofillers. The carbon nanofillers were added to solutions that included 0.075 mL of the aqueous dispersant and 25 mL of water, which was then sonicated for 1 minute to form nanofiller dispersions. The Al/PTFE was mixed with isopropyl alcohol and added to the carbon nanofiller dispersions and again sonicated for 1 minute. After sonication, the solvents were evaporated, leaving a dry mixture of the Al/PTFE and carbon nanofiller. This process is referred to herein as "short sonication mixing."

The carbon nanofiller was sonicated in distilled water for 30 minutes, allowing for complete dispersion (i.e., no settling of carbon nanofiller was visible in solution). The dispersed solution was then sonicated for 1 minute with the Al/PTFE, and then the water was evaporated. During evaporation, the Al/PTFE settled to the bottom and separated itself from the dispersed carbon nanofiller, which settled on top of the Al/PTFE. The dry powders were dry mixed as they were collected and placed in a storage container. This process is referred to herein as "long sonication mixing."

A slurry was prepared by mixing the CNTs in water. The slurry was immediately placed in a freezer. The frozen slurry was then freeze dried to remove the water. The freeze dried CNTs were dry mixed with the Al/PTFE using a vortex mixer until the CNTs were no longer visible in the powder. This process is referred to herein as "dry mixing."

Scanning electron microscopy (SEM) was used to image the samples of energetic material prepared using the three mixing processes described above and determine the carbon nanofiller dispersion quality. As shown in FIG. 1*a*, the short sonication mixing formed a dispersed material with aluminum particles in contact with the larger PTFE particles and CNTs homogeneously dispersed throughout the sample, building a conductive network between the Al and PTFE particles. As shown in FIG. 1*b*, the long sonication mixing also provided a good dispersion of CNTs but resulted in more agglomeration due to the separation of CNTs and Al/PTFE during mixing. As shown in FIG. 1*c*, the dry mixing resulted in agglomeration of the CNTs throughout the material, such as the representative CNT cluster seen in the center of FIG. 1*c*. The SEM images show that the short sonication mixing provided the best dispersion of CNTs and the dry mixing resulted in clumps of aggregated CNTs.

Figure 2:
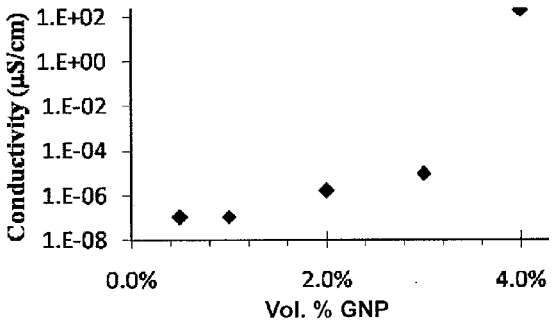
FIGS. 2-7 are graphs depicting the electrical conductivities of energetic materials according to embodiments of the disclosure.

The electrical conductivity of each of the energetic materials was measured by a two-point probing method. The energetic materials were tested for ignition sensitivity from an electrostatic discharge (ESD) using an apparatus built by Franklin Applied Physics. The apparatus had a variable voltage output ranging from 1 kV to 10 kV and charged a 0.002 μF capacitor. The stored electrical energy was discharged through a resistive network and from an electrode pin into the sample of energetic material. The samples had a bulk density of 35% of the theoretical maximal density, which was the same density as was used in the electrical conductivity measurements. Each of the samples was placed on the sample holder disk and the capacitor was lowered towards the pellet to discharge its electric energy. This test has a "go/no go" result, indicating ignition or no ignition of the sample. The electrical conductivity for a control energetic material including only aluminum and PTFE, with no carbon nanofiller, was determined to be $1\times10^{-7}$ μS/cm. FIG. 2 shows the electrical conductivity of the samples as a function of GNP concentration. The electrical conductivity began to increase at 2% by volume of the GNPs, and then increased exponentially, by 7 orders of magnitude, at only 4% by volume of the GNPs. The sharp increase in electrical conductivity consistently occurred between 3% by volume and 4% by volume of the GNP for all three mixing procedures.

Figure 3:
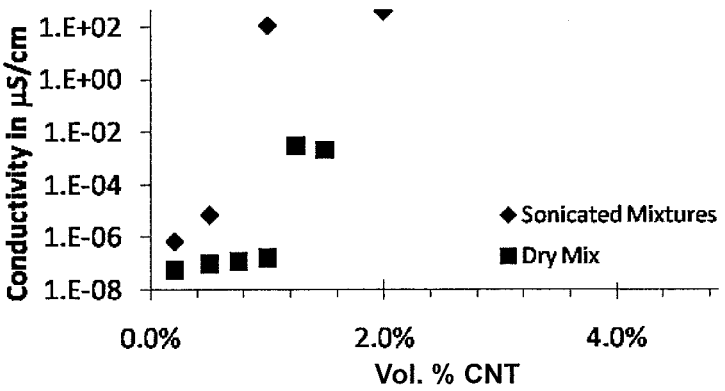

FIG. 3 shows the electrical conductivity as a function of CNT concentration and was consistent for the mixing processes involving sonication (short and long) but different for the dry mixing. For the sonicated mixing (short and long), the electrical conductivity between 0.5% by volume and 1.0% by volume of the CNTs significantly increased by 6.5 orders of magnitude. For the dry mixing, the increase in electrical conductivity occurred between 1.0% by volume and 1.25% by volume of the CNTs. The electrical conductivity of the energetic materials produced by the dry mixing behaved differently than the energetic materials produced by the sonication processes (short and long) in that an electrical conductivity plateau was observed around $2.5\times10^{-3}$ μS/cm and before reaching the maximum conductivity (above 100 μS/cm).

The Al/PTFE with the CNTs experienced an increase in electrical conductivity at lower percentages (between 0.5% by volume and 1.0% by volume for sonication processes and between 1.0% by volume and 1.25% by volume for the dry mixing process) compared to that of the Al/PTFE with the GNPs between 3.0% by volume and 4.0% by volume. The sharp increases in electrical conductivity observed in FIGS. 2 and 3 are a sign of percolation, which is believed to be due to the connectivity of the carbon nanofillers.

Figure 4:
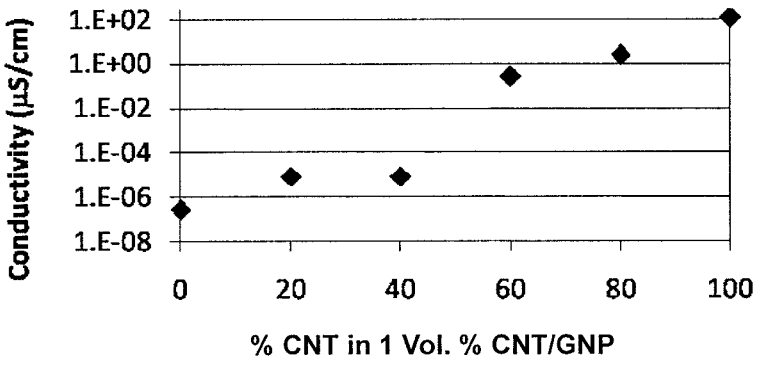

A 1% by volume and 2% by volume of a combination of CNTs/GNPs was added to the Al/PTFE energetic material using the sonication mixing process. The CNT/GNP ratio was varied from 0/100 to 100/0, as shown in Table 1. The electrical conductivity measurements for the 1% by volume CNTs/GNPs combination are shown in FIG. 4. The electrical conductivity of the samples increased as the amount of CNTs used as the carbon nanofiller in the Al/PTFE increased. Therefore, it is believed that the GNPs did not contribute to a rise in electrical conductivity of the Al/PTFE at a concentration of 1% by volume.

Figure 5:
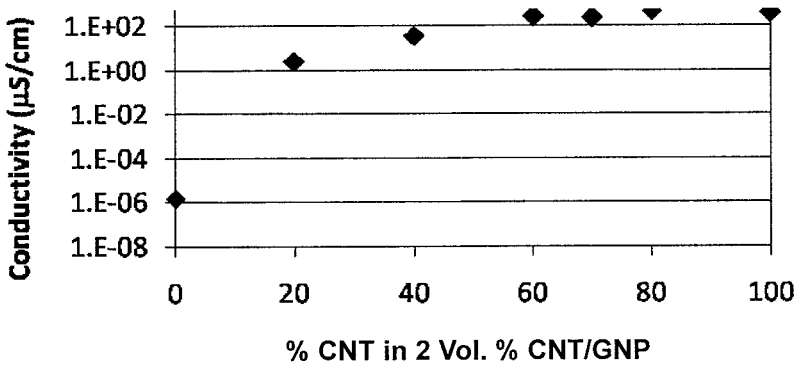

A 2% by volume CNT/GNP was added to the Al/PTFE and the results of the electrical conductivity are shown in FIG. 5. The trend in FIG. 5 was similar to that of FIG. 4 in that the electrical conductivity of the samples increased as the amount of CNT used as the carbon nanofiller increased. However, the largest increase in electrical conductivity occurred at 60% by volume CNTs for the 1% by volume of carbon nanofiller, and at 20% by volume CNTs for the 2% by volume of carbon nanofiller. The percolation threshold corresponding with the volumetric percent of CNTs used in these energetic materials occurred between 0.4% by volume and 0.6% by volume and is consistent with FIG. 3 (i.e., Al/PTFE with only CNTs added). Without being bound to any theory, it is believed that the CNTs in the Al/PTFE energetic material behaved differently than the GNPs in that the CNTs wrap around aluminum and PTFE particles and link together, creating a conductive network throughout the energetic material as seen in FIG. 1*a*.

Figure 6:
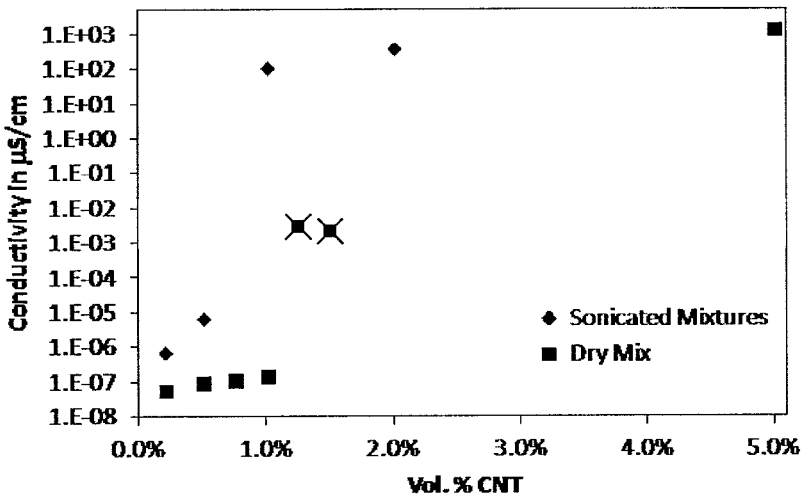

The Al/PTFE and carbon nanofiller energetic materials were further examined for ESD ignition sensitivity, as shown in FIG. 6. The ESD ignition sensitivity was determined by conventional techniques, which are not described in detail herein. The maximum voltage used to create a spark through the samples was 10 kV and corresponded to 100 mJ of energy. All the samples for the two mixing processes involving sonication resulted in no ignition, but the samples prepared by the dry mixing process with 1.25% by volume and 1.5% by volume of CNTs ignited below 100 mJ and, therefore, were deemed ESD ignition sensitive. The average electrical conductivities of the ESD sensitive samples were $2.8\times10^{-3}$ μS/cm and $2.2\times10^{-3}$ μS/cm, respectively. These values are located within an electrical conductivity region previously reported for an aluminum and copper oxide energetic material that was shown to be ESD ignition sensitive only within the conductivity limits between $8.8\times10^{-4}$ μS/cm and $1.2\times10^{-2}$ μS/cm. The data points in FIG. 6 marked with an "X" indicate the energetic materials that resulted in ignition from ESD.

As shown in FIG. 6, the energetic materials with a low electrical conductivity are not ignition sensitive to ESD (conductance (G) and resistance (R) are inversely proportional (power (P)=$V^2/R=V^2\cdot G$, where V is the voltage)). An energetic material with low electrical conductivity resulted in low power absorbed by the energetic material, which implied that the energy delivered to the energetic material did not reach the minimum energy required for ignition. As percolation is achieved with increasing concentration of CNTs, the electrical conductivity increased and the power absorbed by the material also increased. Without being bound by any theory, the energetic materials with high electrical conductivity (around 100 μS/cm) did not ignite because current traveled through the carbon nanofiller and bypassed the Al/PTFE of the energetic material.

The above results demonstrated that carbon nanofillers, such as CNTs, GNPs, and combinations thereof, can be used to tailor the ESD ignition sensitivity of an energetic material. Results showed that the presence of CNTs in the energetic material were the predominant factor in affecting electrical conductivity and ESD ignition sensitivity. The effect of the CNTs is believed to be due to their morphology, which wraps around elemental fuel and oxidizer particles. Without being bound by any theory, it is believed that the CNTs provided improved connectivity throughout the energetic material. In fact, the electrical conductivity of a control Al/PTFE composition was $1\times10^{-7}$ μS/cm and the electrical conductivity was found to significantly increase, by almost 10 orders of magnitude, to a conductivity of 100 μS/cm with the addition of only 4% by volume GNPs and 1% by volume CNTs to the energetic material. When a combination of CNT/GNP carbon nanofillers was tested, the low volumetric percentages of CNTs created an increase in the electrical conductivity, controlling the percolation threshold. The energetic materials with a high electrical conductivity did not ignite because the current traveled through the carbon nanofillers, bypassing heating and ignition of the energetic material. Al/PTFE energetic materials having an electrical conductivity around 0.002 μS/cm did ignite and showed that a correlation exists between electrical conductivity and ESD ignition sensitivity.

Example 2

Al/CuO Energetic Materials

Figure 7:
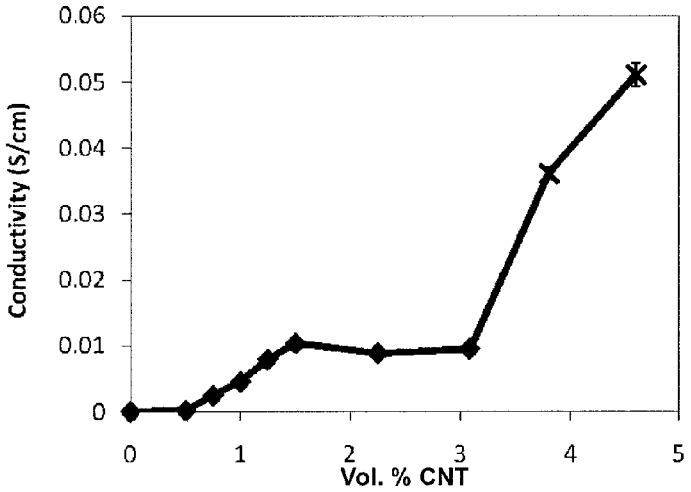

Energetic materials including nanopowder aluminum, copper(II) oxide, and CNTs were prepared. The energetic material had an F/O ER of 1. The CNTs were added at volumetric percentages ranging from 0.5% by volume to 4.6% by volume. The electrical conductivity was determined for each of the energetic materials. As shown in FIG. 7, energetic materials having less than or equal to about 3% by volume of the CNTs were ESD sensitive. However, the energetic materials having 3.8% by volume and 4.6% by volume of the CNTs, indicated in FIG. 7 with "X's," were not ESD sensitive.

Example 3

Al/$KClO_4$ Energetic Materials

Energetic materials including aluminum powder and potassium perchlorate were prepared. The energetic materials included between about 25% by weight and about 30% by weight aluminum powder and between about 65% by weight and about 70% by weight potassium perchlorate. Carbon fiber rods were added at 1% by volume and 5% by volume. The carbon fiber rods were purchased from Toho Tenax America (Rockwood, Tenn.) under the TENAX® tradename (type PLS012). The energetic materials were prepared by mixing the aluminum powder, potassium perchlorate, and carbon fiber rods.

Figure 8:
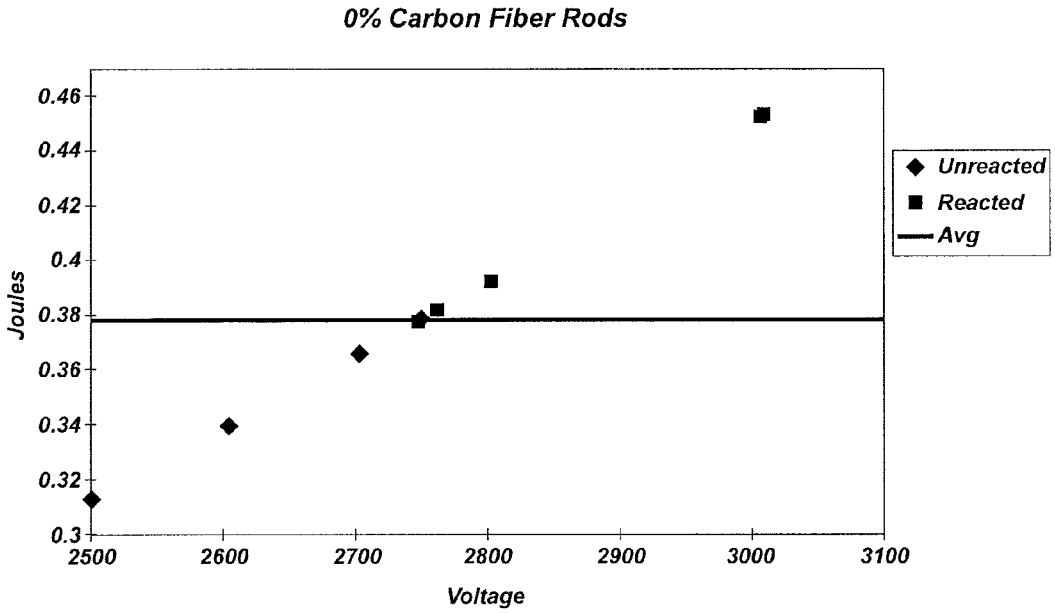
FIGS. 8-10 are graphs depicting the average energy utilized to ignite energetic materials according to embodiments of the disclosure.
Figure 9:
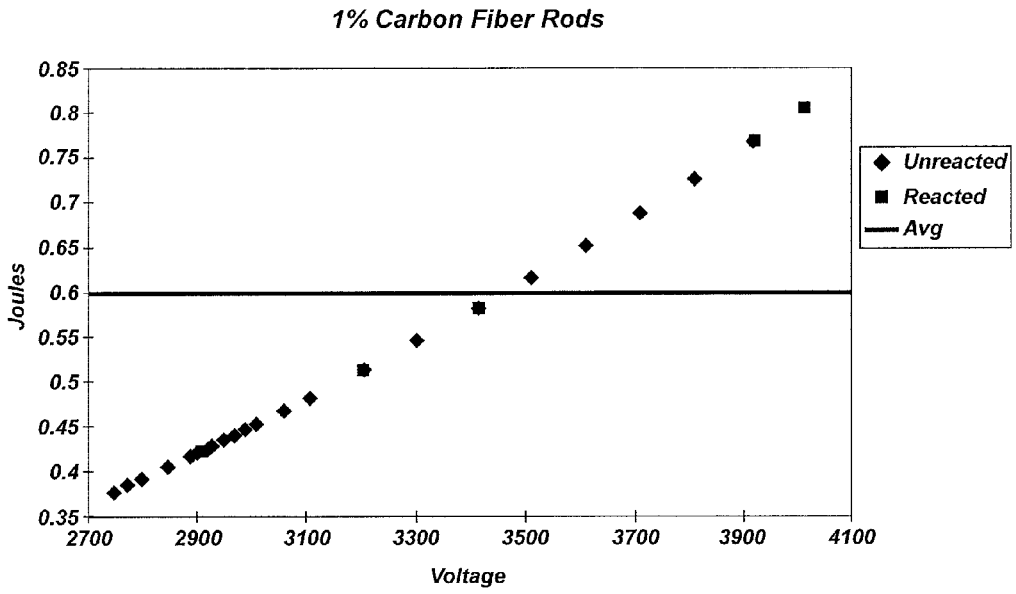
Figure 10:
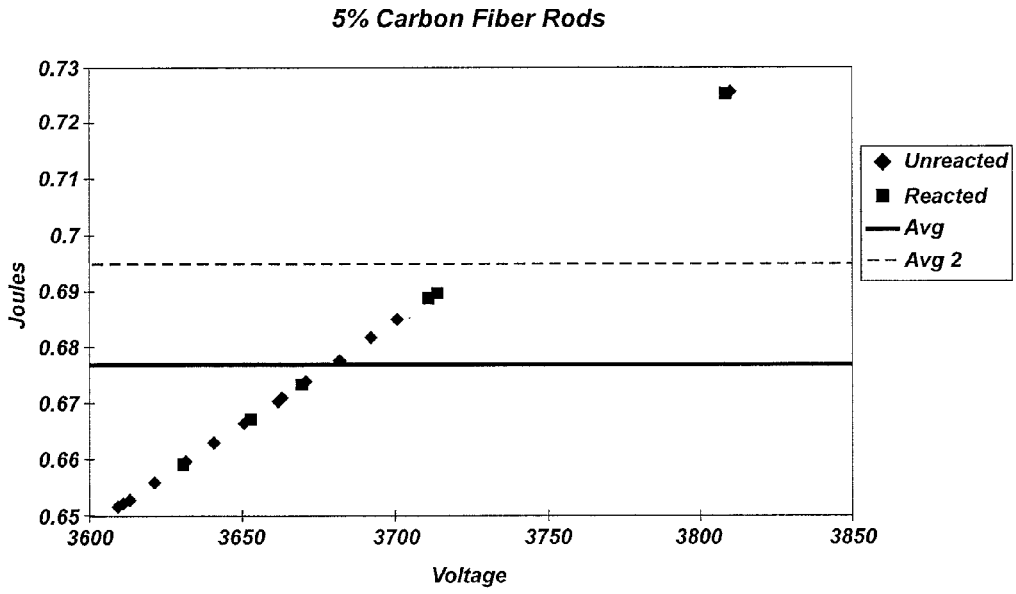

The amount of energy needed to ignite each energetic material was determined, including for a control energetic material lacking the carbon fiber rods. As shown in FIG. 8, an energetic material including about 30 wt % aluminum and about 70 wt % potassium perchlorate, but lacking the carbon fiber rods, utilized an average energy of 0.378 Joules to ignite the energetic material. As shown in FIG. 9, the energetic material including the aluminum powder, potassium perchlorate, and 1% by volume of the carbon fiber rods utilized an average energy of 0.599 Joules to ignite the energetic material. As shown in FIG. 10, an energetic material including the aluminum powder, potassium perchlorate, and 5% by volume of the carbon fiber rods utilized an average energy of 0.677 Joules to ignite the energetic material. Thus, as the percentage of carbon fibers in the energetic materials increased, the average energy needed to ignite the energetic materials also increased.

While the disclosure may be susceptible to various modifications and alternative forms, specific embodiments have been shown by way of example in the Examples and drawings and have been described in detail herein. However, it should be understood that the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. An energetic material comprising:

an elemental fuel comprising an average particle size of between about 20 nm and about 20 μm;

an oxidizer comprising an average particle size of between about 20 nm and about 100 μm;

a carbon nanofiller; and carbon fiber rods, wherein the carbon nanofiller is substantially homogeneously dispersed in the energetic material.

2. The energetic material of claim 1, wherein the carbon nanofiller comprises carbon nanotubes, graphene nanoplatelets, or combinations thereof.

3. The energetic material of claim 2, wherein openings in the carbon nanotubes are substantially free of the oxidizer.

4. The energetic material of claim 2, wherein openings in the carbon nanotubes are substantially free of the elemental fuel.

5. The energetic material of claim 1, wherein the elemental fuel comprises aluminum, boron, beryllium, hafnium, lanthanum, lithium, magnesium, neodymium, tantalum, thorium, titanium, yttrium, zirconium, or combinations thereof.

6. The energetic material of claim 1, wherein the oxidizer comprises an oxide, a perchlorate, a permanganate, a fluoropolymer, or combinations thereof.

7. The energetic material of claim 1, wherein the oxidizer comprises a silver oxide, a boron oxide, a bismuth oxide, a cobalt oxide, a chromium oxide, a copper oxide, an iron oxide, a mercury oxide, an iodide oxide, a manganese oxide, a molybdenum oxide, a niobium oxide, a nickel oxide, a lead oxide, a palladium oxide, an tin oxide, a tantalum oxide, a titanium oxide, a uranium oxide, a vanadium oxide, a tungsten oxide, a silicon oxide, or combinations thereof.

8. The energetic material of claim 1, wherein the oxidizer comprises potassium perchlorate, sodium perchlorate, ammonium perchlorate, potassium permanganate, ammonium permanganate, sodium permanganate or combinations thereof.

9. The energetic material of claim 1, wherein the oxidizer comprises polytetrafluoroethylene (PTFE), a copolymer of hexafluoropropylene and vinylidene fluoride, a terpolymer of tetrafluoroethylene, hexafluoropropylene, and vinylidene fluoride, or combinations thereof.

10. The energetic material of claim 1, wherein the energetic material comprises aluminum, PTFE, and at least one of carbon nanotubes and graphene nanoplatelets.

11. The energetic material of claim 1, wherein the energetic material comprises aluminum, copper(II) oxide, and at least one of carbon nanotubes and graphene nanoplatelets.

12. The energetic material of claim 1, wherein the energetic material excludes an energetic material consisting of aluminum, manganese oxide, and carbon nanotubes.

13. The energetic material of claim 1, wherein the elemental fuel comprises aluminum and the oxidizer comprises boron, carbon, calcium, cerium, cobalt, chromium, copper, iron, lanthanum, lithium, manganese, nickel, palladium, praseodymium, platinum, plutonium, sulfur, tantalum, titanium, uranium, vanadium, zirconium, or combinations thereof.

14. The energetic material of claim 1, wherein the carbon nanofiller comprises from about 0.5% by volume to about 25% by volume of the energetic material.

15. A method of tailoring electrostatic discharge sensitivity of an energetic material, comprising:

substantially homogeneously dispersing a carbon nanofiller and carbon fiber rods with an elemental fuel and an oxidizer to form an energetic material, the elemental fuel comprising an average particle size of between about 20 nm and about 20 μm and the oxidizer comprising an average particle size of between about 20 nm and about 100 μm.

16. The method of claim 15, wherein substantially homogeneously dispersing a carbon nanofiller and carbon fiber rods with an elemental fuel and an oxidizer comprises combining from about 0.5% by volume to about 25% by volume of the carbon nanofiller in the energetic material.

17. The method of claim 15, wherein substantially homogeneously dispersing a carbon nanofiller and carbon fiber rods with an elemental fuel and an oxidizer comprises substantially homogeneously dispersing the carbon nanofiller in the energetic material at an amount exceeding the percolation threshold.

18. The method of claim 15, wherein substantially homogeneously dispersing a carbon nanofiller and carbon fiber rods with an elemental fuel and an oxidizer comprises creating electrical connections through the energetic material to dissipate electrostatic discharge.

19. The method of claim 15, wherein substantially homogeneously dispersing a carbon nanofiller and carbon fiber rods with an elemental fuel and an oxidizer comprises combining carbon nanotubes, graphene nanoplatelets, or combinations thereof with the elemental fuel and oxidizer.

20. The method of claim 15, further comprising drying the energetic material.

21. An energetic material comprising:

an elemental fuel, an oxidizer, and carbon fiber rods, wherein the carbon fiber rods are substantially homogeneously dispersed in the energetic material.

22. The energetic material of claim 1, wherein the oxidizer comprises a metal oxide.

* * * * *